US007426836B2

(12) United States Patent
Jmaev

(10) Patent No.: US 7,426,836 B2
(45) Date of Patent: Sep. 23, 2008

(54) METHOD AND APPARATUS FOR AIR CONDITIONING USING A PRIMARY AND AN ANCILLARY POWER SOURCE

(76) Inventor: Jack Ivan Jmaev, 12616 Lewis Ave., Chino, CA (US) 91710

( * ) Notice: Subject to any disclaimer, the term of this patent is extended or adjusted under 35 U.S.C. 154(b) by 147 days.

(21) Appl. No.: 11/170,575

(22) Filed: Jun. 28, 2005

(65) Prior Publication Data

US 2006/0288720 A1 Dec. 28, 2006

(51) Int. Cl.
*F25B 27/00* (2006.01)

(52) U.S. Cl. ..... 62/115; 62/235.1; 62/236; 62/228.5

(58) Field of Classification Search ..... 62/115, 62/235.1, 236, 510, 196.2, 228.5
See application file for complete search history.

(56) References Cited

U.S. PATENT DOCUMENTS 4,015,962 A * 4/1977 Tompkins ..... 62/175
4,086,072 A * 4/1978 Shaw ..... 62/160
4,362,030 A * 12/1982 Voorhis ..... 62/510
4,720,980 A * 1/1988 Howland ..... 62/81

* cited by examiner

*Primary Examiner*—William E Tapolcai

(57) ABSTRACT

A method for air conditioning using a primary power source augmented with an ancillary power source which is accomplished by receiving a heat-laden first working fluid at an initial pressure; pre-pressurizing the heat-laden first working fluid to a pre-pressurization pressure according to an amount of available ancillary power; passing the pre-pressurized heat-laden first working fluid to a primary compressor when the pressure of the pre-pressurized heat-laden first working fluid is greater than the initial pressure; and passing the heat-laden first working fluid at the initial pressure, or at a pressure that is slightly less that the initial pressure, to the primary compressor when the pressure of the pre-pressurized heat-laden first working fluid is not greater than the initial pressure.

9 Claims, 7 Drawing Sheets

METHOD AND APPARATUS FOR AIR CONDITIONING USING A PRIMARY AND AN ANCILLARY POWER SOURCE

BACKGROUND

Modern dwelling units and other structures commonly incorporate some form of air-conditioning system. Use of air-conditioning systems in residential applications has become more and more commonplace over the years. Many other structures, such as factories and office buildings, integrate air conditioning systems into their facilities.

Most air-conditioning systems are structured according to traditional heat pump principles. In a typical cooling system, a refrigerant is used as a working fluid in a closed-loop heat pump application. Two types of systems have evolved in most regions of the country; integrated systems and split-systems. Integrated systems comprise a single operational unit that comprises all of the components necessary to pump heat. Split-systems segregate the functionality of the heat pump into two sections, one for heat removal and the other for heat dispersal.

Split-system air conditioning apparatus have found favor in small volume applications including single family dwelling units, apartments, small offices and other small industrial facilities. These split-systems typically comprise an indoor unit and an outdoor unit. In the air conditioning trade, the indoor unit is commonly called a "heat exchanger" because it exchanges cooler air for warmer found in a comfort volume. Heat from the comfort volume is carried away by the working fluid. The outdoor unit is normally referred to as a "heat pump" or a "compressor". The outdoor unit typically comprises a compressor that is used to introduce work into the system effecting the heat transfer cycle.

The indoor unit typically comprises an evaporator and a fan element. The fan element is used to direct warm air from the living space, i.e. the comfort volume, through the evaporator. As the warm air from the comfort volume passes through the evaporator, the working fluid, i.e. the refrigerant, absorbs heat from the air. The air that leaves the evaporator is cooler than the air entering the evaporator. The net effect of removing heat from the circulating air reduces the temperature in the comfort volume.

As the working fluid traverses through the system, it typically enters the evaporator as a very cool liquid. As the working fluid absorbs heat from the warm air passing through the evaporator, it will generally experience a rise in temperature. This rise in temperature causes the working fluid to change state from a liquid to a vapor. The vaporized working fluid then leaves the evaporator and is directed to the outdoor unit.

As the vaporized working fluid enters the outdoor unit, i.e. the "heat pump", it encounters a compressor. The compressor pressurizes the working fluid; which is in a vaporous state. In many cases, the working fluid will reach a super-heated state after compression.

The high-pressure and high-temperature vapor then enters a condenser. The outdoor unit typically further comprises a fan that drives outside ambient air through the condenser. As the working fluid traverses the condenser, it loses some of its heat to the outside air. As the working fluid leaves the condenser, it typically remains in a pressurized, vaporous state. The working fluid then passes through an expansion valve. This allows the pressure of the working fluid to be reduced. This pressure reduction results in condensation of the working fluid. After passing through the expansion valve, the working fluid becomes a cool, low-pressure liquid. The cool liquid working fluid is routed back to the indoor unit to complete the cooling cycle.

Most of these traditional air-conditioning systems utilize an electric motor to drive the compressor included in the outdoor unit. The work imparted by the electric motor onto the compressor requires significant energy. In many instances, the amount of work expended will significantly increase the cost of electric utility charges incurred by the occupant of the home or business facility.

Several alternative means of cooling an indoor space have been suggested in attempts to reduce or completely avoid electric power consumption. In one known method, a Sterling cycle has been used to create an air-conditioning system driven by waste heat captured from other systems such as a water heating apparatus disposed in the facility. When waste heat is not available, a Sterling cycle based cooling systems needs to burn some other fuel in order to maintain comfort in the target environment.

A Sterling cycle air-conditioning system may also be driven by solar energy. The notion of using solar energy to drive cooling systems is quite intriguing. This is especially true in light of the fact that air conditioning systems are typically used during hot summer months when solar incidence is high. One problem with these Sterling cycle apparatus is inefficiency. The Sterling cycle itself is not especially efficient. Hence, large solar arrays are required to obtain the power needed to cool even a moderate sized dwelling unit or office complex.

One other disadvantage with Sterling cycle systems is the fact that when radiant energy from the sun is not directly available, ancillary heat sources are required to maintain the cooling cycle. Many prior art Sterling cycle based systems rely on natural gas heating elements to augment the Sterling cycle when solar radiation is insufficient.

Solar energy has been used to drive a simple Rankine cycle based motor generator. In these prior art systems, inefficiency is again the compromising factor because the solar radiation captured through the Rankine cycle must be first converted into rotating work by some form of a turbine. The work produced by the turbine is then used to generate electricity. The electrical energy is then converted into rotating work by a motor that drives a compressor. The compressor is used to force a working fluid through a refrigeration cycle. Each of these conversion stages introduces significant inefficiencies in the final air condition system structure.

A Rankine cycle solar air conditioning system still needs to be augmented with utility power when solar energy is not sufficient to maintain comfort in the target cooling volume. This further complicates Rankine motor-generator systems because of the need to synchronize the AC output of the motor generator to the power line provided by the utility company.

Solar energy can be used to augment conventional, electrically driven air conditioning systems. One known technique uses photovoltaic cells (a.ka. solar cells) to generate DC power. Photovoltaic cells, though, are typically not very efficient and they are still very expensive. The surface area of a suitable solar collector needed to cool a typical residential unit may be too large and expensive to be practical. Even more discouraging is the fact that a solar cell has a limited life and the output produced by a solar cell drops off sharply with age.

Techniques relying on electrical energy created by photovoltaic cells must also include an inverter that is capable of converting DC power provided by the photovoltaic cells into an AC voltage that is synchronized to the utility line. This is not a simple process because the output of the inverter must be continuously adjusted in voltage, frequency and phase to ensure delivery of power into the utility power line. Typically the phase of the inverter's output must be continuously adjusted in phase relative to the phase of the utility power to ensure positive power flow.

Notwithstanding the inefficiencies associated with these prior art techniques, the need to augment any solar based air-conditioning system with utility power complicates the overall system design. The complicated structures necessary to combine solar derived AC or DC power with the AC power obtained from a utility company result in additional system costs that may prove prohibitive and commercially unviable in most applications.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

Figure 1:
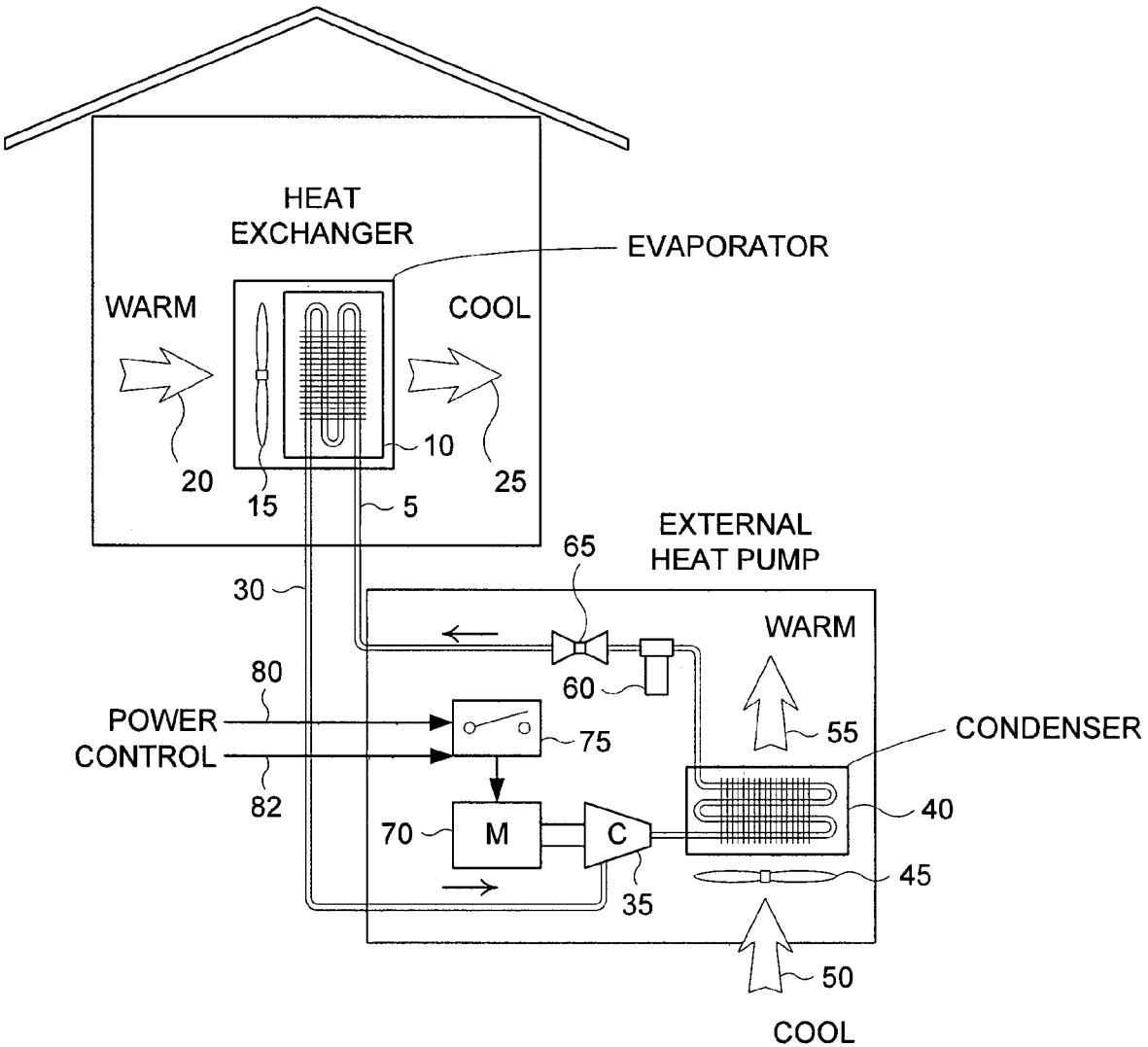
FIG. 1 is a pictorial representation of a typical split-system cooling apparatus of prior art.

FIG. 1 is a pictorial representation of a typical split-system cooling apparatus of prior art. A split-system typically comprises a heat exchanger. The heat exchanger is typically deployed proximate to a comfort volume that is the target environment that is to be cooled. The heat exchanger typically comprises an evaporator 10 and a fan 15.

As a working fluid traverses the cooling system, it enters the evaporator as a cool liquid at juncture 5. The cool liquid working fluid absorbs heat from warm air 20 that is directed through the evaporator's 10 coils by the fan 15. Having discharged heat through the evaporator 10, cooler air 25 is discharged into the comfort volume. In a typical system, the working fluid increases in temperature as it passes through the evaporator 10 and changes state from a liquid to a vapor. At juncture 30, the working fluid has absorbed heat from the warm air 20 and is typically a hot vapor. The heat-laden, vaporized working fluid is then directed to an outdoor heat pump unit.

The heat pump unit is typically deployed outside of the comfort volume being cooled by the system. This external heat pump unit typically comprises a motor 70, a compressor 35, a condenser 40 and a fan 45. Most external heat pump units further comprise a contactor 75. As the heat-laden, vaporized working fluid enters the heat pump unit, it typically encounter the compressor 35. The compressor 35 is driven by the motor 70. Electrical power is engaged onto the motor by the contactor 75. The contactor typically receives a control signal 82 that is derived from a thermal control disposed within the comfort volume. The purpose of the control signal is to engage power 80 obtained from a public utility into the motor 70 whenever cooling of the comfort volume is required.

The motor 70 imparts work onto the compressor 35. The compressor typically raises the pressure of the vaporized working fluid. As the pressure of the working fluid increases, it experiences an influx of heat that is proportional to the amount of work introduced into the system by the motor 70. It should be noted that the heat influx may not necessarily be accompanied by a rise in temperature. It should be noted that the efficiencies of the motor 70 and the compressor 35 will typically result in less influx of heat into the working fluid than might would otherwise be expected based on the actual amount of power introduced into the system.

The working fluid that leaves the compressor 35 is typically at an elevated pressure. At this state, the working fluid still remains in a vaporous state. In some systems, the working fluid may become super heated at this stage due to the additional heat introduced through the pressurization process. The high temperature, pressurized working fluid is directed to a condenser 40. The fan 45 directs cool air 50 from an ambient environment through the coils of the condenser 45. The cool air 50 flowing through the condenser 40 absorbs heat from the working fluid. Warm air 55 leaves the condenser 40 and thus carries away heat absorbed from the working fluid.

The external heat pump typically further comprise an accumulator 60. As the working fluid leaves the condenser 40, it is typically still in a vaporous state. Any quantity of working fluid that has transitioned from vapor to liquid is collected in the accumulator 60 in order to prevent liquid working fluid from encountering an expansion valve 65 that also is included in the heat pump unit. Once past the accumulator 60, the working fluid is typically at a lower temperature than before it entered the condenser 40, but it is still under the pressure of the compressor 35.

The expansion valve 65 allows the high-pressure working fluid to flash through into a lower pressure condition. As pressure is lost through the expansion valve 65, the working fluid condenses. At this point, the working fluid is a cool, low-pressure liquid that again is directed toward the heat exchanger disposed within the comfort volume. The cooling cycle is then allowed to repeat itself.

Figure 2:
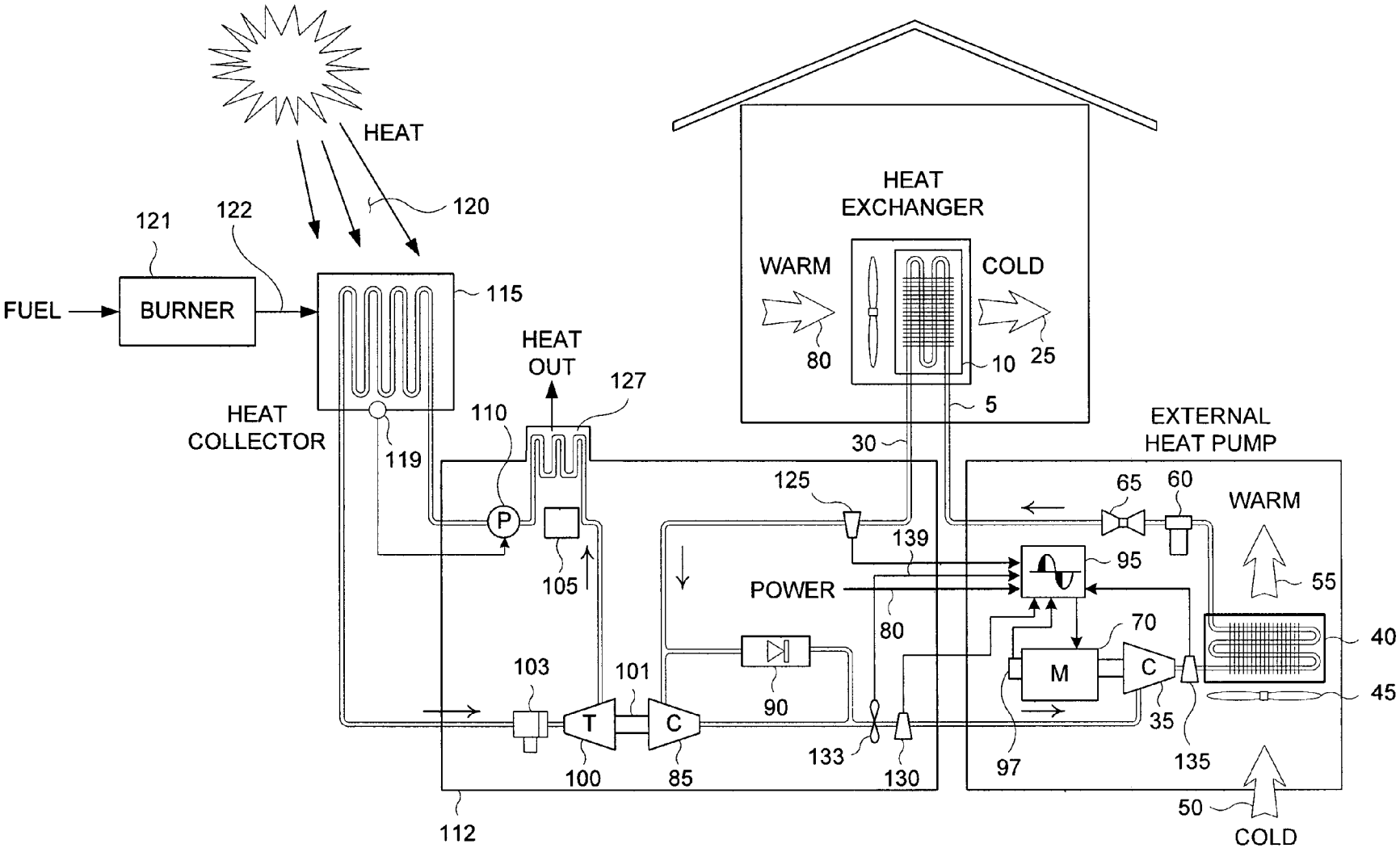
FIG. 2 for is a pictorial depiction of an apparatus for augmenting traditional refrigeration systems with an ancillary heat source according to one illustrative embodiment of the present intention.

FIG. 2 is a pictorial diagram of an apparatus for augmenting traditional air conditioning systems with an ancillary power source according to one illustrative embodiment of the present method. According to this illustrative embodiment, heat from an ancillary source 120 is collected by a heat collector 115. In one embodiment, the heat collector 115 comprises a solar panel tailored to collect heat in the form of solar radiation. It should be noted that any ancillary heat source can be used to augment traditional air conditioning systems and that the scope of the claims appended hereto is not intended to be limited to solar heat absorption. In one alternative embodiment, waste heat is collected from a water heater flue. In yet another alternative embodiment, the ancillary heat source comprises a natural gas burner that consumes natural gas and creates heat that is collected by the heat collector 115. Again, the intent is to collect heat from any convenient source and to use that heat to augment a refrigeration cycle.

In this example of embodiment, a second working fluid traverses a collection path. The collection path is formed by the heat collector 115, a collection of components referred to as an "augmentation unit" 112, and the plumbing necessary to connect the heat collector 115 to the augmentation unit 112. The augmentation unit 122, according to one embodiment, comprises a pump 110. The pump 110 circulates the second working fluid through the collection path. As the second working fluid leaves the pump 110, it is pressurized and is typically in the form of a cool liquid. This cool liquid second working fluid is directed to the heat collector 115. The second working fluid comprises a refrigerant compound that is typically vaporized as it absorbs heat in the heat collector 115. Ordinarily, but not necessarily, the second working fluid would leave the heat collector 115 in a super heated state. Hence, one characteristics of the second working fluid is that it exhibit a low enough boiling point to allow vaporization as moderate heat 120 is applied to the heat collector 115.

As the second working fluid leaves the heat collector 115, it is typically in a vaporized state. Generally, the second working fluid will be at a greater pressure than before it was heated in the heat collector 115. The vaporized second working fluid may in fact achieve a super-heated condition. The vaporized second working fluid is then directed to a turbine 100. The turbine 100 converts the heat energy contained in the vaporized second working fluid into mechanical work. In some embodiments of the present invention, the form of the mechanical work is rotational. In another alternative embodiment, a diaphragm pump replaces the turbine and augmentation compressor. As the second working fluid is discharged from the turbine 100, it will lose pressure. This may result in a state transition from vapor to liquid. In some embodiments, not all of the second working fluid will be vaporized through the heat collector. To prevent any non-vaporized second working fluid from reaching the turbine 100, a trap assembly 103 is disposed in the collection path prior to the turbine 100. The trap assembly 103 collects non-vaporized second working fluid. In one embodiment, the augmentation unit further comprises a condenser 127. The condenser enables the second working fluid to shed even more heat so that the second working fluid again becomes a liquid that can be pumped by the pump 110.

In some embodiments, a temperature sensor 119 is disposed at the heat collector 115. The temperature sensor 119 is used to determine if sufficient heat is present at the heat collector 115 to enable the collection cycle. If sufficient heat is not present at the heat collector 115, a signal derived from the temperature sensor 119 is used to turn off the pump 110 so that the second working fluid is not caused to traverse the collection path needlessly.

The collection path forms a heat engine that creates useful mechanical work from waste heat, solar radiation or heat generated specifically (e.g. by burning a fuel) to drive the heat engine. This useful work is typically in the form of rotational work that is applied to an augmentation compressor 85 that is included in the augmentation unit 112. In most applications, the augmentation unit 112 is inserted into the return path of an air conditioning system. The augmentation unit 112 is inserted into the return path that directs a first working fluid traversing an air-conditioning system wherein this return path directs the first working fluid from an evaporator 10 to a compressor 35. In the present example embodiment, the augmentation unit 112 is inserted into the return path leading from a heat exchanger disposed proximate to a comfort volume and an outdoor heat pump unit which is typically installed outside of the comfort volume.

As the first working fluid leaves the evaporator 10, it is laden with heat collected from the comfort volume as described supra. Ordinarily, this heat-laden first working fluid would be directed to the external heat pump unit where it would immediately encounter a compressor 35. According to this example embodiment, the heat-laden first working fluid first encounters the augmentation compressor 85 comprising the argumentation unit 112.

When the heat engine is provided with sufficient heat 120, useful work 101 from the heat engine (e.g. from the turbine 100) is applied to the augmentation compressor 85. The augmentation compressor 85 is used to pre-pressurize a heat-laden, first working fluid. This pre-pressurized heat-laden, first working fluid is then directed from the augmentation unit 112 to the external heat pump unit. Once the pre-pressurized, heat-laden, first working fluid enters the external heat pump unit, it encounters the compressor 35. The compressor 35, according to the definitions of the present method comprises a "primary compressor". The primary compressor 35 raises the pressure of the heat-laden first working fluid where it is subsequently directed to the condenser 40. It should be noted that the amount of work that must be introduced into the refrigeration cycle by the motor 70 is typically reduced proportionate to the amount of pre-pressurization introduced by the augmentation compressor 85.

In those situations where the augmentation compressor 85 is either not running or is not providing significant pre-pressurization, a one-way bypass valve 90 is used to shunt the augmentation compressor 85. The one-way bypass valve 90 is disposed having its input connected to the input of the augmentation compressor 85 and its output connected to the output of the output augmentation compressor 85. When the pressure at the input of the augmentation compressor 85 is greater than the pressure at the output of the augmentation compressor 85, the first working fluid is allowed to propagate through the one-way bypass valve 90 thus completing the refrigeration system cooling path. It should be noted that the one-way bypass valve 90 may introduce some trivial loss in pressure as the heat-laden working fluid passes through the value 90.

In most applications, the external heat pump unit comprises a contactor 75 that is used to engage utility power 80 to drive the motor 70. The motor 70 is used to apply mechanical work to the compressor 35, thus driving the refrigeration cycle. According to one example embodiment, the contactor 75 is replaced by a power controller 95. The power controller 95 receives utility power 80 and directs that utility power to the motor 70. The power controller 95, according to one alternative embodiment, comprises a pulse-width-modulation (PWM) controller that adjusts the power directed to the motor 70. The power controller 95 in this example embodiment receives a first pressure indication from a first pressure transducer 135. The first pressure transducer 135 is disposed immediately after the compressor 35. The power controller 95 continuously adjusts the power directed to the motor 70 in order to maintain a constant pressure at the output of the compressor 35.

According to this example embodiment, the first pressure transducer 135 is disposed immediately after the compressor 35. In some applications, especially where an existing air conditioning system is being retrofitted, introduction of this first pressure transducer 135 may be problematic. In a typical upgrade situation, the external heat pump unit comprises an integrated system fabricated by an air-conditioning system manufacturer. In such an upgrade scenario, there may be insufficient space available within the confines of the external heat pump unit to install the first pressure transducer 135. In such cases, the first transducer 135 is omitted and replaced by a second pressure transducer 130. The second pressure transducer 125 is disposed immediately after the augmentation compressor 85. In those embodiments where the first pressure transducer 135 cannot be viably installed, the power controller 95 receives pressure indications from the second pressure transducer 130. In this alternative embodiment, the power controller 95 adjusts the power delivered to the motor 70 based on the pressure of the first working fluid as it about to enter the primary compressor 35. This method allows for an approximate regulation of the output pressure of the first working fluid emanating from the compressor 35. In yet another alternative embodiment, a third pressure transducer 125 is installed in the augmentation unit 112 immediately prior to the augmentation compressor 85. In this alternative embodiment, the power controller 95 receives pressure indications from the second pressure transducer 130 and the third pressure transducer 125 and controls the amount of power applied to the motor 70 based on the differential pressure exhibited across the augmentation compressor 85.

According to one alternative example embodiment, the power controller 95 further comprises a minimum power threshold. The minimum power threshold ensures that the compressor 35 continues to propagate the first working fluid from the augmentation unit through to the condenser 40. This is necessary in those instances where the work introduced by turbine 100 into the refrigeration cycle is alone sufficient to maintain cooling of the comfort volume. In these situations, the compressor 35 must be maintained at a constant volumetric capacity. Practically speaking, this means that the motor 70 must maintain a constant speed irrespective of the amount of pre-pressurization introduced by the augmentation compressor 85. Typically, the role of the power controller 95 is to reduce the work performed by the motor 70 while maintaining the motor at a constant rotational speed. In some embodiments, a tachometer 97 is disposed in a manner so as to discover the speed of the motor 70. The power controller 95, in this alternative example embodiment, uses the tachometer to maintain the speed of the motor at a constant rate. The power controller 90, according to one alternative embodiment, also receives a signal 80 to engage power only when cooling is required. Such a signal may be derived from a thermostatic control disposed in the comfort volume. In yet another example embodiment, the power controller 95 receives a signal from a flow detector 133 that is included in the augmentation unit and controls the amount of power applied to the motor 70 in order to maintain a substantially constant flow through the compressor 35. In one embodiment, the flow detector 133 is disposed in the augmentation unit 112 just prior to where the first working fluid leaves the augmentation unit 112.

In some embodiments, the power controller 95 does not support the minimum power threshold. In these configurations, a bypass valve is installed into the external heat pump unit. In this alternative embodiment, the bypass valve is disposed with its input attached to the input of the compressor 35 and its output attached to the output of the compressor 35. The bypass valve, although not shown in the figure, provides a path for the first working fluid to pass by the compressor 35 when the compressor is not running. This path allows the first working fluid to reach the condenser 40 when the compressor 35 is not running. This happens when the turbine 100 is providing sufficient power to maintain the refrigeration cycle. It should be noted that this bypass valve is a one-way valve directing the first working fluid from the input of the compressor 35 to the output of the compressor 35 and does not allow the working fluid leaving the output of the compressor 35 to return to the input of the compressor 35. In those embodiments where a bypass valve is installed across the compressor 35, the power controller 95 may in fact shut down in the motor 70 completely when there is sufficient work provided by the turbine 100 to allow the augmentation compressor 85 to propagate the first working fluid through the refrigeration system at full cooling capacity.

The present invention further comprises a method for upgrading existing refrigeration systems. The method applied is equally suitable to air-conditioning systems installed in residential or commercial structures, or to air-conditioning systems not yet installed. In those applications of the present invention where an air-conditioning system is already installed and is cooling a target comfort volume, the method of the present invention provides for insertion of an augmentation unit 112 in the return path of the air-conditioning system. In those applications where the air-conditioning system is not yet installed, the method of the present invention provides for insertion of the augmentation unit 112 into the return path of the air-conditioning system as it is being installed.

Accordingly, one illustrative embodiment comprises an augmentation unit 112 that comprises a turbine 100 that generates mechanical work as a heated second working fluid passes through said turbine 100. The augmentation unit further comprises an augmentation compressor 85 that raises the pressure of a working fluid it receives according to the amount of mechanical work it receives from the turbine 100. In yet another illustrative embodiment, the augmentation unit 112 further comprises a one-way by-pass valve 90 that is disposed to allow the working fluid to bypass the augmentation compressor 85 when the output of the augmentation compressor is not at a pressure sufficient to overcome the by-pass valve 85.

In yet another alternative embodiment, a system for augmentation of an air condition system further includes a flow meter disposed to provide an indication of flow of a first working fluid. In yet another alternative embodiment, a system for augmentation of an air condition system further includes a tachometer disposed to provide an indication of the speed of the primary compressor included in a heat pump unit. It should be noted that the tachometer, in an alternative embodiment, is disposed to provide an indication of the speed of motor that drives the primary compressor or any other mechanical linkage that is used to impart mechanical work to the primary compressor.

In yet another alternative embodiment, the augmentation unit further comprises a pump 110 for circulating a second working fluid through a heat collection path as heretofore described. In yet another alternative embodiment, the augmentation unit further includes a condenser 127 for removing excess heat from the second working fluid after it is expelled by the turbine 100. One alternative embodiment of the system further comprises a heat collection unit 115 that is used to impart ancillary heat to the second working fluid. In yet another alternative embodiment, a system for augmenting an air-conditioning system further includes a burner for burning a fuel. The burner 121 burns fuel in order to generate heat 122 that is directed to the heat collection unit 115.

In yet another alternative embodiment, the augmentation unit further comprises a power controller 95 that is installed in a heat pump so as to control the amount of power applied to a motor that drives a primary compressor included in the heat pump. In yet another alternative embodiment, a system for augmenting an air conditioning system further includes a pressure transducer 135 that is disposed to provide a pressure indication according to the pressure of a first working fluid leaving the compressor 35. In yet another alternative embodiment, a system for augmenting an air conditioning system further includes a pressure transducer 130 that is disposed to provide a pressure indication according to the pressure of a first working fluid entering the compressor 35. In yet another alternative embodiment, a system for augmenting an air conditioning system further includes a pressure transducer 125 that is disposed to provide a pressure indication according to the pressure of a first working entering the augmentation compressor 85.

One significant alternative embodiment of the present invention is an integrated augmented external heat pump unit. In this alternative embodiment, the components of the augmentation unit 112, which comprise a pump 110, a turbine 100, an augmentation compressor 85 and a one-way bypass valve 90, are integrated into an external heat pump unit. Hence, the present invention also comprises an integrated augmented external heat pump unit that includes all or any combination of these elements.

Figure 3:
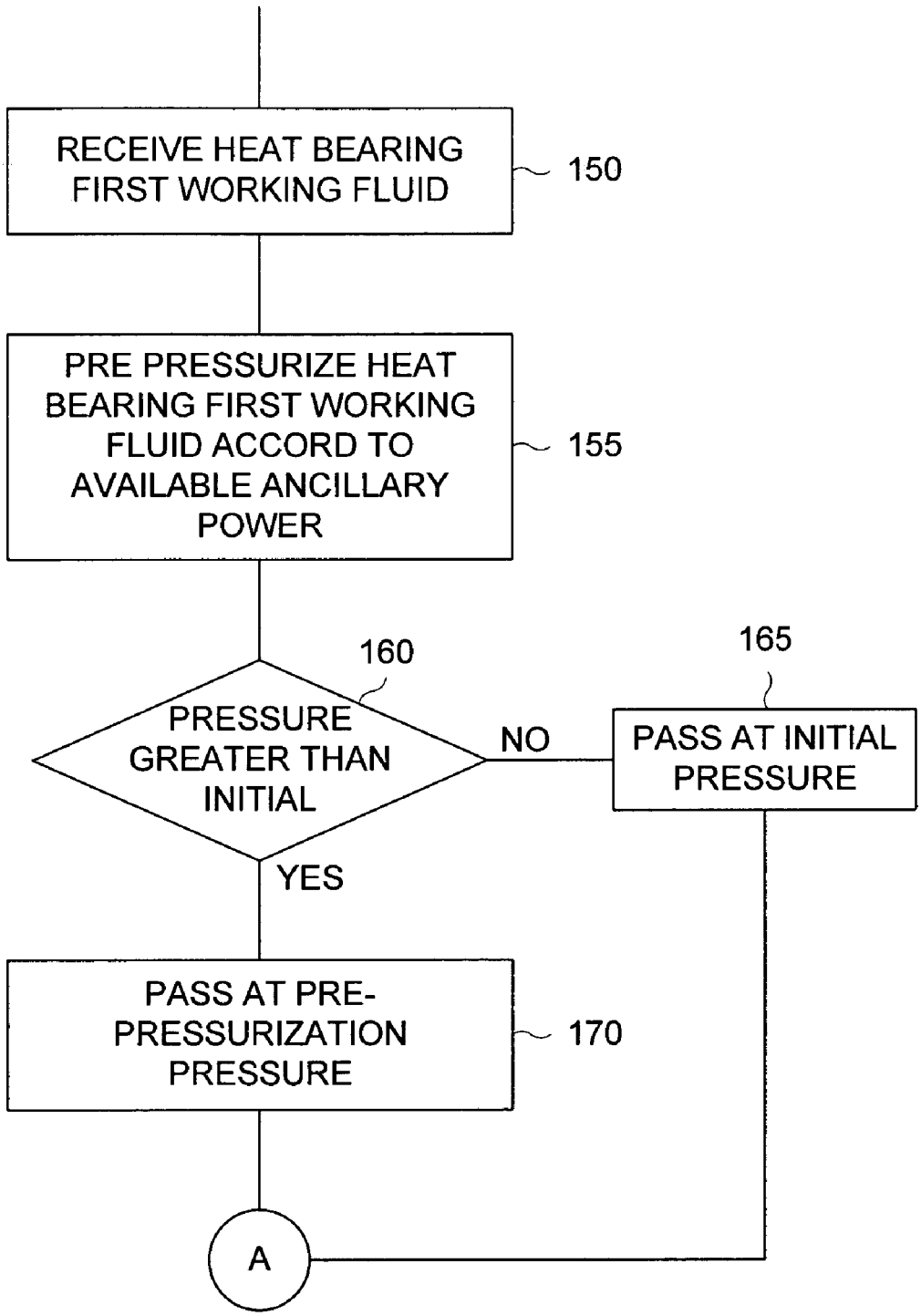
FIG. 3 is a flow diagram that depicts one example method for air-conditioning using a primary power source augmented with an ancillary power source.

FIG. 3 is a flow diagram that depicts one example method for air-conditioning using a primary power source augmented with an ancillary power source. It should be appreciated that the various illustrative embodiments presented heretofore are embodiments of a method and variations thereof as herein described. According to one example method, air-conditioning using a primary power source which is augmented with an ancillary power source is accomplished by receiving a heat-laden first working fluid (step 150). It should be appreciated that the heat-laden first working fluid is received at an initial pressure and is typically received from a heat exchanger used to cool a comfort volume. The present method further provides for pre-pressurizing the heat-laden first working fluid so as to raise the pressure of the heat-laden first working fluid to a "pre-pressurization" pressure (step 155). It should further be appreciated that raising the pressure is accomplished according to an available amount of ancillary power. For example, the pre-pressurization pressure will be less in cases where the available ancillary power is at a lower level. When the available ancillary power is at a higher level, the pre-pressurization pressure will be greater.

According to one variation of the present method, the pre-pressurized, heat-laden first working fluid is directed to a primary compressor (step 170) when the pressure achieved through pre-pressurization is greater than the initial pressure at which the heat-laden first working fluid is received. It should further be appreciated that the pressure gradient which needs to be achieved in order to pass the pre-pressurized first working fluid must also overcome a bypass valve which is used to allow the heat-laden first working fluid to be passed to the primary compressor (step 165) when there is not enough available ancillary power to achieve the required pressure gradient.

Figure 4:
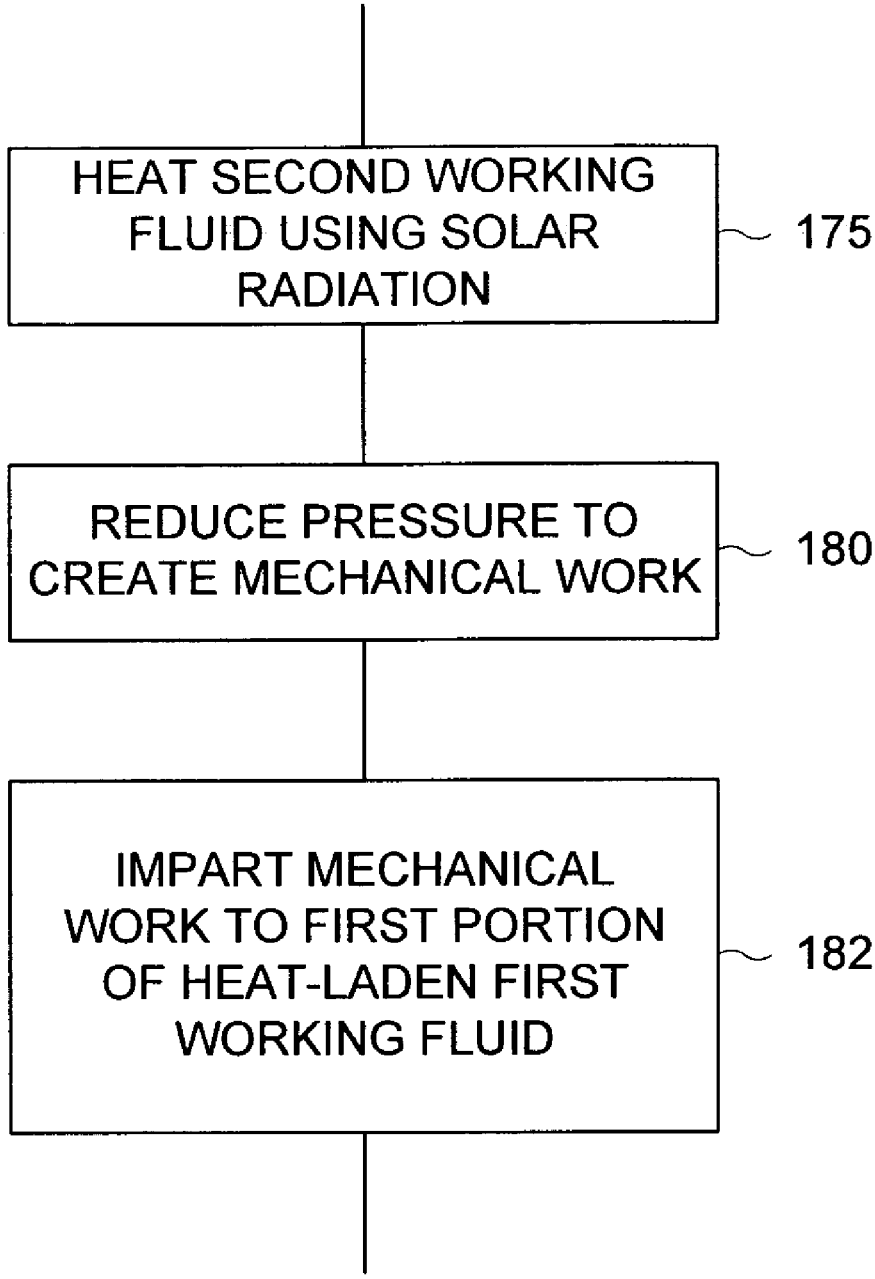
FIG. 4 is a flow diagram that depicts one example method for pre-pressurizing a heat-laden first working fluid by using solar energy.

FIG. 4 is a flow diagram that depicts one example method for pre-pressurizing a heat-laden first working fluid by using solar energy. According to this illustrative example method, a heat-laden, first working fluid is pre-pressurized by heating a second working fluid using solar radiation (step 175). By heating the second working fluid, the pressure of the second working fluid is typically increased. The pressure of the second working fluid is then reduced in order to create mechanical work (step 180). The mechanical work is then imparted to a first portion of the heat-laden first working fluid (step 182). By imparting mechanical work to the first portion of the heat-laden, first working fluid, the pressure of the first working fluid is increased according to the amount of mechanical work applied thereto. It should also be appreciated that, according to one variation in present method, only a first portion of the first working fluid of is subjected to pre-pressurization because a smaller portion may bypass the pre-pressurization process in those situations where an insufficient amount of mechanical work is available to achieve a significant pressure gradient between the first initial pressure at which the first working fluid is received and a pre-pressurization pressure level.

Figure 5:
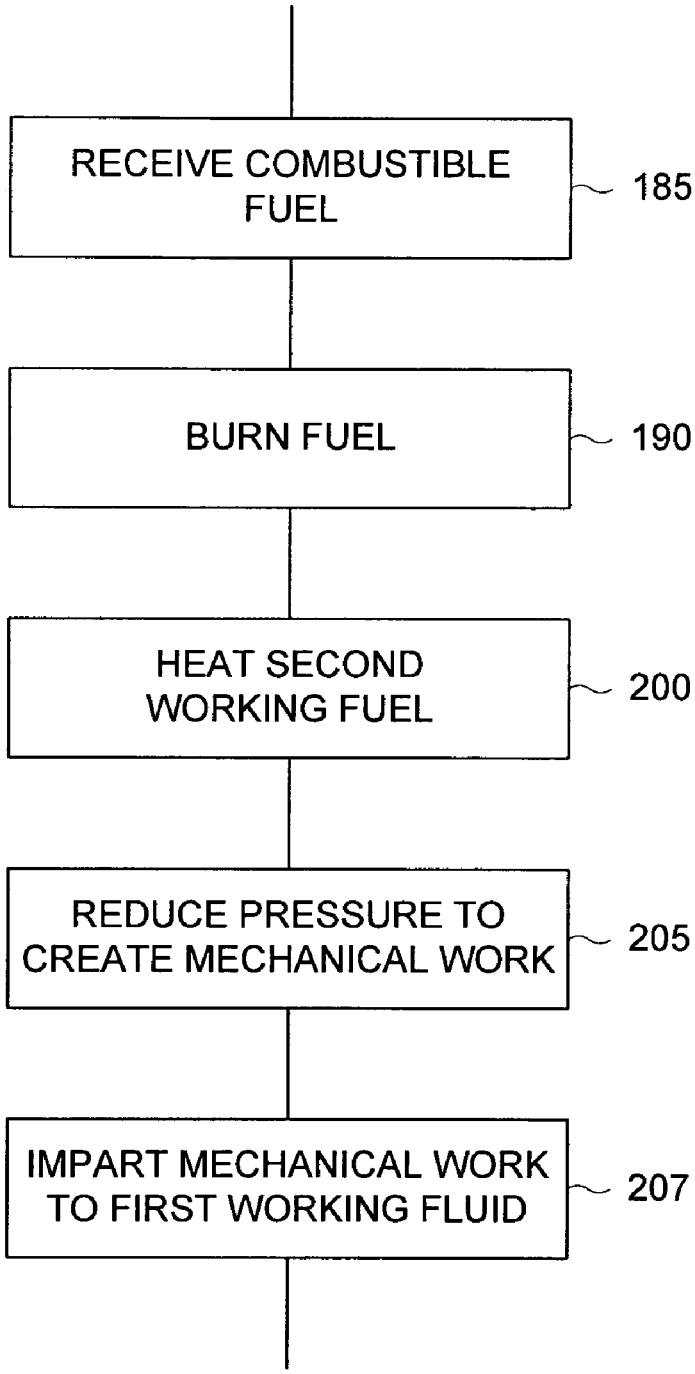
FIG. 5 is a flow diagram that depicts one alternative example method for pre-pressurizing a heat-laden first working fluid by burning a combustible fuel.

FIG. 5 is a flow diagram that depicts one alternative example method for pre-pressurizing a heat-laden first working fluid by burning a combustible fuel. It should be appreciated that, according to one alternative example variation of the present method, a combustible fuel is received (step 185). The combustible fuel is then burned (step 190). The burning fuel will create heat which is used to heat a second working fluid (step 200). Heating of the second working fluid increases the pressure thereof. The pressure of the second working fluid is then reduced in order to create mechanical work (step 205). The mechanical work is then imparted to a first portion of the heat-laden first working fluid (step 207). By imparting mechanical work to the first portion of the heat-laden first working fluid, the pressure of the first working fluid is increased according to the amount of mechanical work applied thereto. It should also be appreciated that, according to one variation in present method, only a first portion of the first working fluid of is subjected to pre-pressurization because a smaller portion may bypass the pre-pressurization process in those situations where an insufficient amount of mechanical work is available to achieve a significant pressure gradient between the first initial pressure at which the first working fluid is received and a pre-pressurization pressure level.

Figure 6:
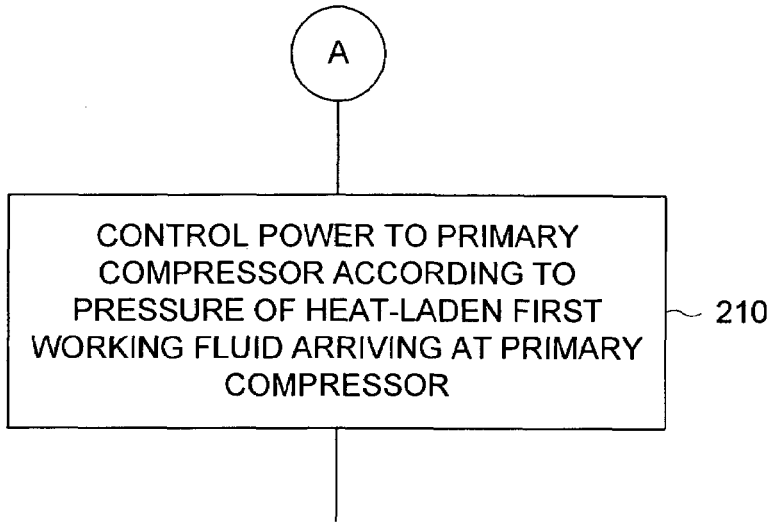
FIGS. 6, 7 and 8 are flow diagrams that depict alternative methods wherein power applied to a primary compressor is controlled.
Figure 7:
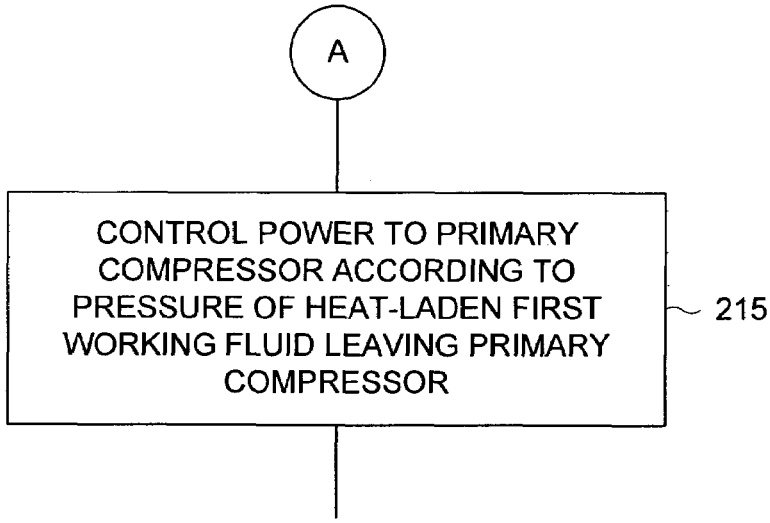
Figure 8:
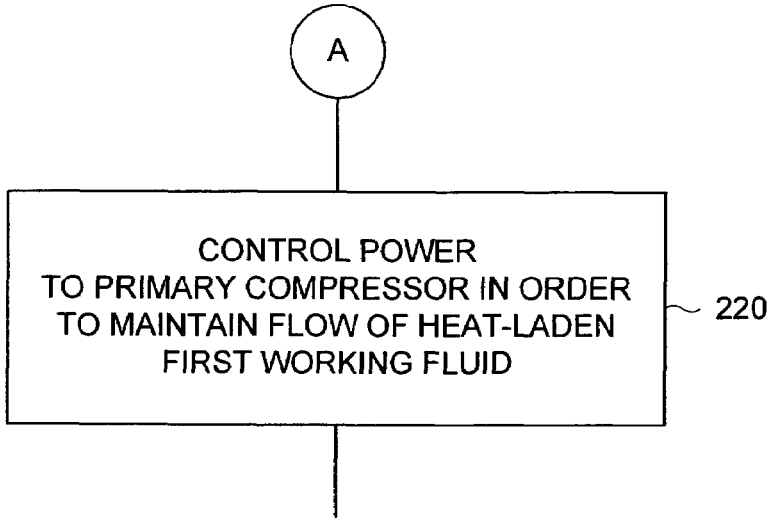

FIGS. 6, 7 and 8 are flow diagrams that depict alternative methods wherein power applied to a primary compressor is controlled. According to one variation of the present method, the power applied to a primary compressor is controlled according to the pressure of the heat-laden first working fluid as it arrives at the primary compressor (step 210). According to another example variation of the present method, the power applied to the primary compressor is controlled according to the pressure of the heat-laden first working fluid leaving the primary compressor (step 215). In yet another example variation of the present method, the power applied to a primary compressor is controlled in order to maintain a flow of heat-laden first working fluid through the primary compressor (step 220). In one alternative method, this is accomplished by actually monitoring the flow using a flow meter. In another example alternative method, this is accomplished by maintaining the speed at which the primary compressor is operating.

Figure 9:
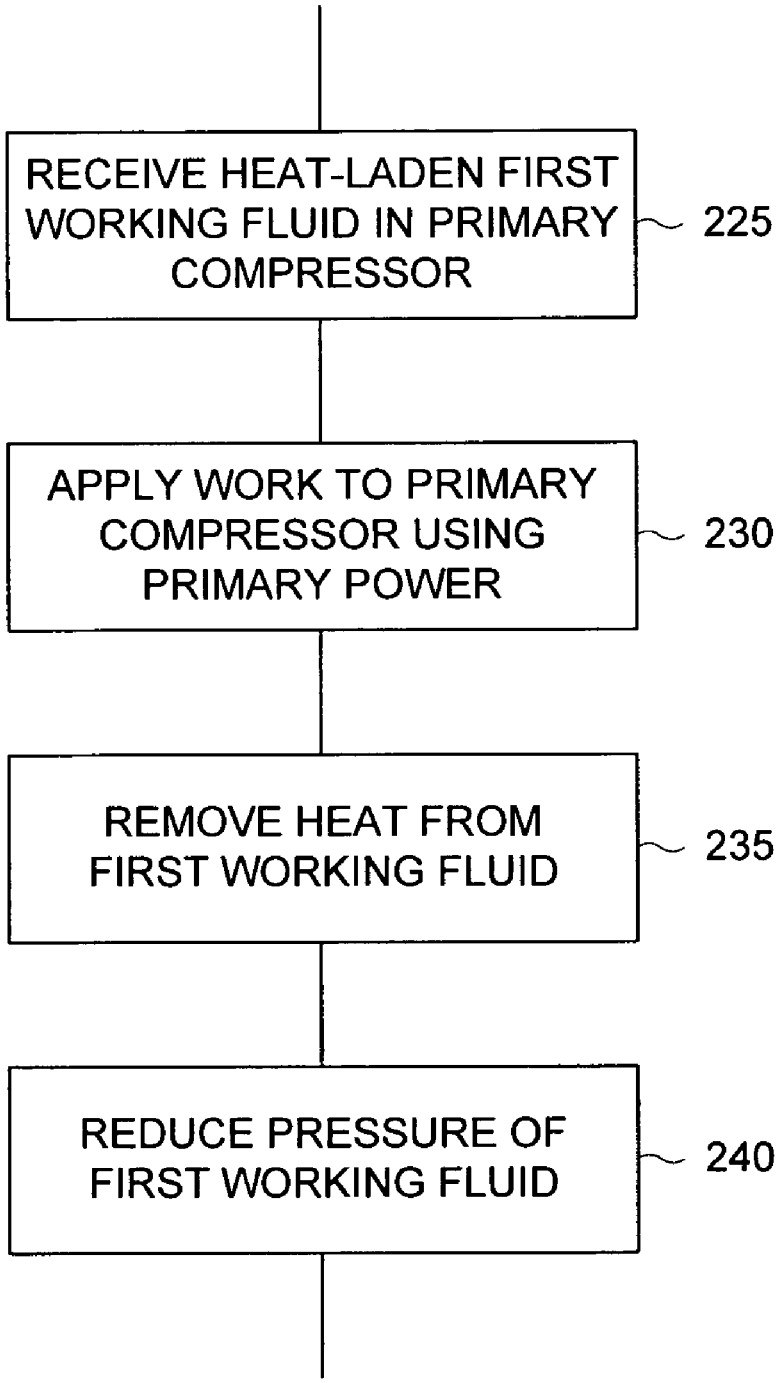
FIG. 9 is a flow diagram that depicts an alternative example method wherein a heat-laden first working fluid is further pressurized using primary power.

FIG. 9 is a flow diagram that depicts an alternative example method wherein a heat-laden first working fluid is further pressurized using primary power. According to this variation of the present method, the heat-laden first working fluid is received in a primary compressor (step 225). The primary compressor is then driven using primary power (step 230). It should be appreciated that the heat-laden first working fluid is received either at a pre-pressurized pressure level when it arrives from an augmentation compressor or at the pressure level that is slightly less than an initial pressure as the heat-laden first working fluid bypasses the augmentation compressor. It should be appreciated that the amount of primary power applied to primary compressor is controlled, according to various alternative methods, according to the pressure of the heat-laden working fluid as it arrives at the primary compressor, or according to the pressure of the heat-laden working fluid as it leaves the primary compressor or in a manner so as to maintain a substantially constant flow of the heat-laden working fluid through the primary compressor.

FIG. 9 further illustrates that, according to one alternative method, air-conditioning is further accomplished by removing heat from the heat-laden first working fluid (step 235) and then reducing the pressure the first working fluid (step 240) commensurate with the pressure level stool for presentation of the first-working fluid to a heat exchanger.

While this invention has been described in terms of several alternative methods and exemplary embodiments, it is contemplated that alternatives, modifications, permutations, and equivalents thereof will become apparent to those skilled in the art upon a reading of the specification and study of the drawings. It is therefore intended that the true spirit and scope of the present invention include all such alternatives, modifications, permutations, and equivalents.

What is claimed is:

1. A method for air conditioning using a primary power source augmented with an ancillary power source comprising:

receiving a heat-laden first working fluid at an initial pressure;

pre-pressurizing the heat-laden first working fluid to a pre-pressurization pressure according to an amount of available ancillary power;

passing the pre-pressurized heat-laden first working fluid to a primary compressor when the pressure of the pre-pressurized heat-laden first working fluid is greater than the initial pressure; and passing the heat-laden first working fluid at the initial pressure, or at a pressure that is slightly less that the initial pressure, to the primary compressor when the pressure of the pre-pressurized heat-laden first working fluid is not greater than the initial pressure; and applying work to the primary compressor in order to raise the pressure of the first working fluid to a final working pressure, wherein the amount of work applied to the primary compressor is determined according to the amount of available ancillary power.

2. The method of claim 1 wherein pre-pressurizing the heat-laden first working fluid comprises:

heating a second working fluid using radiation received from the sun;

reducing the pressure of the pre-pressurized second working fluid to create mechanical work; and imparting the mechanical work to a first portion of the heat-laden first working fluid to increase the pressure thereof.

3. The method of claim 2 wherein pre-pressurizing the heat-laden first working fluid comprises:

receiving a combustible fuel;

burning the combustible fuel;

heating a second working fluid using heat produced by the burning fuel;

reducing the pressure of the pre-pressurized second working fluid to create mechanical work; and imparting the mechanical work to a first portion of the heat-laden first working fluid to increase the pressure thereof.

4. The method of claim 1 wherein the amount of of available ancillary power is determined according to the pressure of the heat-laden working fluid arriving at the primary compressor.

5. The method of claim 1 wherein the amount of of available ancillary power is determined according to the pressure of the heat-laden working fluid as it leaves the primary compressor.

6. The method of claim 1 further comprising:

removing heat from the heat-laden first working fluid;

reducing the pressure of the first working fluid; and accepting heat into the reduced pressure first working fluid.

7. A method for air conditioning using a primary power source augmented with an ancillary power source comprising:

receiving a heat-laden first working fluid at an initial pressure;

pre-pressurizing the heat-laden first working fluid to a pre-pressurization pressure according to an amount of available ancillary power;

passing the pre-pressurized heat-laden first working fluid to a primary compressor when the pressure of the pre-pressurized heat-laden first working fluid is greater than the initial pressure; and passing the heat-laden first working fluid at the initial pressure, or at a pressure that is slightly less that the initial pressure, to the primary compressor when the pressure of the pre-pressurized heat-laden first working fluid is not greater than the initial pressure;

and applying a minimal amount of work to the primary compressor when the pressure of the pre-pressurized working fluid is approximately equal to a final working pressure, wherein the amount of work applied to the primary compressor is controlled in order to maintain through the primary compressor a pre-established flow of heat-laden working fluid.

8. The method of claim 7 wherein pre-pressurizing the heat-laden first working fluid comprises:

heating a second working fluid using radiation received from the sun;

reducing the pressure of the pre-pressurized second working fluid to create mechanical work; and imparting the mechanical work to a first portion of the heat-laden first working fluid to increase the pressure thereof.

9. The method of claim 7 wherein pre-pressurizing the heat-laden first working fluid comprises:

receiving a combustible fuel;

burning the combustible fuel;

heating a second working fluid using heat produced by the burning fuel;

reducing the pressure of the pre-pressurized second working fluid to create mechanical work; and imparting the mechanical work to a first portion of the heat-laden first working fluid to increase the pressure thereof.

* * * * *